United States Patent [19]

Eckels

[11] 4,036,139

[45] July 19, 1977

[54] ELECTRICALLY INITIATED FUSE IGNITOR

[76] Inventor: Robert Edward Eckels, 2101 Youngfield, Golden, Colo. 80401

[21] Appl. No.: 647,661

[22] Filed: Jan. 9, 1976

[51] Int. Cl.[2] ..... C06C 5/06

[52] U.S. Cl. ..... 102/28 R; 102/27 R

[58] Field of Search ..... 102/27 R, 28 R, 28 EB

[56] References Cited

U.S. PATENT DOCUMENTS

| | | | |
|---|---|---|---|
| 225,173 | 3/1880 | Smith | 102/28 |
| 784,226 | 3/1905 | Quinn | 102/28 |
| 855,224 | 5/1907 | Broadwater | 102/28 |
| 2,968,985 | 1/1961 | Seavey | 102/28 |
| 3,422,763 | 10/1965 | Wait | 102/28 |

FOREIGN PATENT DOCUMENTS

| | | | |
|---|---|---|---|
| 725,516 | 3/1955 | United Kingdom | 102/27 R |
| 857,281 | 12/1960 | United Kingdom | 102/28 EB |

*Primary Examiner*—Verlin R. Pendegrass

[57] ABSTRACT

A fuse or the like, for the ignition of a detonator, partially cut at an angle to its longitudinal axis to expose the ignition train, having an electrically actuated ignition device mounted in the cut in contact with the ignition train.

10 Claims, 5 Drawing Figures

ELECTRICALLY INITIATED FUSE IGNITOR

This application covers the invention described in Disclosure Document No. 027610, dated Jan. 21, 1974, of the Patent Office Document Disclosure Program.

Conventionally used commercial electric detonator caps have the disadvantage of an inherent hazard of premature ignition from extraneous electrical sources such as lightning stactic electricity, R. F. transmissions (usually F M signals), galvanic cells, and the like. Such electrically actuated detonator caps regularly fire at about 0.25 amperes, with a safety reservation that 0.06 amperes, or more, represents a hazard of unintentional initiation.

In many instances where a plurality of electric caps are used, with a plurality of explosives charges, such as are used in construction work and mining, there is a reason to include delays between charges or series of charges to reduce seismic shock or to obtain particular types of rock breaks. Concurrently, it is not always necessary that the initial cap detonation be instantaneous, and a short delay of, for example a one or two second delay, for the initial cap detonation may be tolerated without creating any new problems.

The present invention provides a simple method of accomplishing fuse initiation electrically to gain most of the advantages of electrical initiation, yet reduce most of the hazards usually related to electrically actuated detonation caps. The present method provides some inherent delay, a short delay of a second or so to predetermined longer times of delay, after imposing the initial current. Briefly the invention involves the soldering of a short bridgewire, long enough to span the diameter of the fuse, about ¼ inch, to two electric lead wires which in turn may be connected into a firing circuit. The bridgewire is a pyro-alloying wire producing an exothermic reaction when initiated by a reasonably strong electric current. The bridgewire is made of one of the platinum group of metals and aluminum. One commercially available bridgewire is sold under the trademark of "Pyrofuse" manufactured by Sigmund Cohn Co. The mounted bridgewire is pulled into a cut, made half way through the fuse, and it may be taped into proper position when desired. Preferrably, the cut is made at an angle in the fuse, directed away from a cap mounted on the end of the fuse. The cut must be sufficiently deep to enter or expose the ignition train, but must be made only deep enough to maintain tensile strength to the assembly. When the leads to the bridgewire carry a sufficient current, the bridgewire shorting across the leads is heated, initiating the alloy reaction, which gives off a substantial amount of heat and sparks sufficient to ignite the ignition train of the fuse, the fuse in turn detonates the cap.

The bridgewire may be used to ignite "Ignitacord", a thermite cord, which may, also, be used in the detonating system. Although Ignitacord is not recommended for use to initiate caps in a direct manner, it may be used. The bridgewire may be used to initiate a cap or a squib directly instead of a fuse, to avoid delay caused by the use of the fuse. This method, however, may introduce several safety considerations which are not found by putting the bridgewire in the slot of the fuse mentioned above.

A series of timed spaced detonations may be arranged with a plurality of explosive charges by changing the length of the fuse to the various caps from the bridgewires to provide for successive explosions in the series. The length of the delay intervals is a simple function of the burning rate of the ignition train of the fuse, and the length of the fuse is from the bridgewire to the cap determines the delay.

Included among the objects and advantages of the present invention is to provide an electrically initiated detonation of a cap.

Another object of the invention is to provide the electrical detonation of a cap by system which requires a high current thereby producing a very safe system.

Another object of the invention is to provide a detonation system for a cap utilizing a safety fuse, and a pyro-alloying bridgewire which is initiated by a high current for igniting the ignition train of the fuse.

Still another object of the invention is to provide an electrically initiated detonation of a cap utilizing a fuse which is electrically ignited to provide a predetermined time delay in the detonation of the cap from the activation of the electrical circuit.

Yet another object of the invention is to provide an electrically actuated cap detonation utilizing a simple, safe system without the use of sensitive, electrically actuated caps.

These and other objects and advantages of the invention may be readily ascertained by referring to the description and appended illustrations in which.

Figure 1:
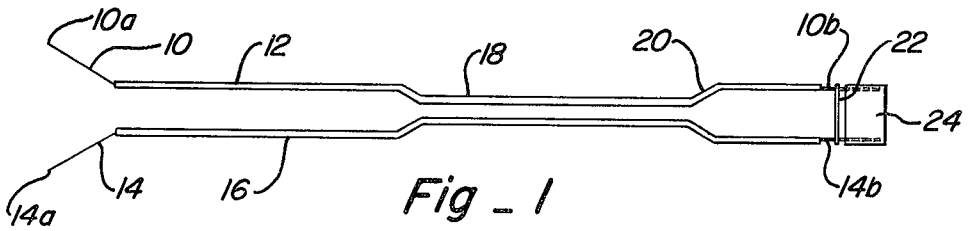
FIG. 1 is top plan view of a bridgewire ignitor for a fuse.
Figure 2:
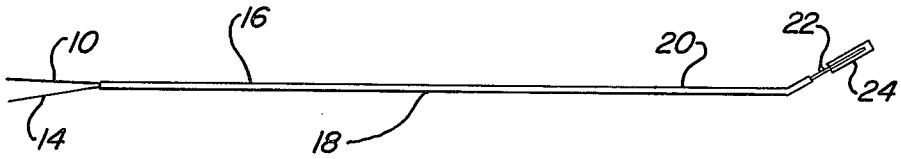
FIG. 2 is a side elevational view of the device of FIG. 1.

The fuse ignitor illustrated in FIGS. 1 and 2 includes an electric lead wire 10 covered by insulation 12, and a lead wire 14 covered by insulation 16. The bare ends of lead wires **10*a* and 14*a* are to be attached to a two lead, electric circuit wire, and, of course, must be separated, to prevent shorting across the leads of the electric ignitor. The insulated wires are necked down providing a short length 18 where the wires are close together, and are again expanded at point 20 so that ends 10*b* and 14*b* are spaced a distance, to effectively stradle a fuse, as explained below. A bridgewire 22 is soldered across the ends 10*b* and 14*b* providing an electrically connection across the leads. A plastic reinforcing member 24 is welded or otherwise secured to the ends of the leads, holding the ends apart and protecting the bridgewire 22**. The plastic strengthing member may be a small sheet of a thermo-plastic resin, for example polyethylene, polypropylene, etc. Which provides some strength to the unit, and is easily secured to the wires by heating to melt the wires into the plastic. The plastic, of course, may be secured in the other means such as cement, or the like.

Figure 3:
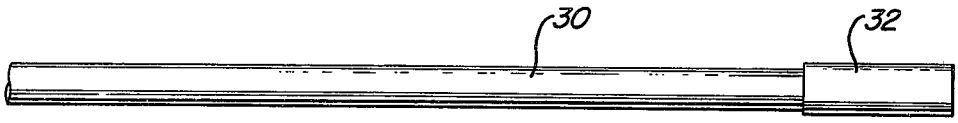
FIG. 3 is a side elevational view of a portion of a fuse and fuse ignited, detonating cap attached thereto.
Figure 4:
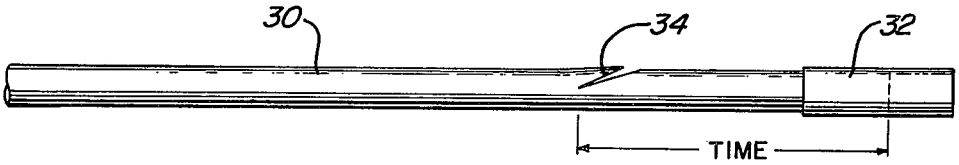
FIG. 4 is a side elevational view of a device similar to that of FIG. 3, having a slit cut at an angle to the longidudinal axis of the fuse and into the ignition train of the fuse.
Figure 5:
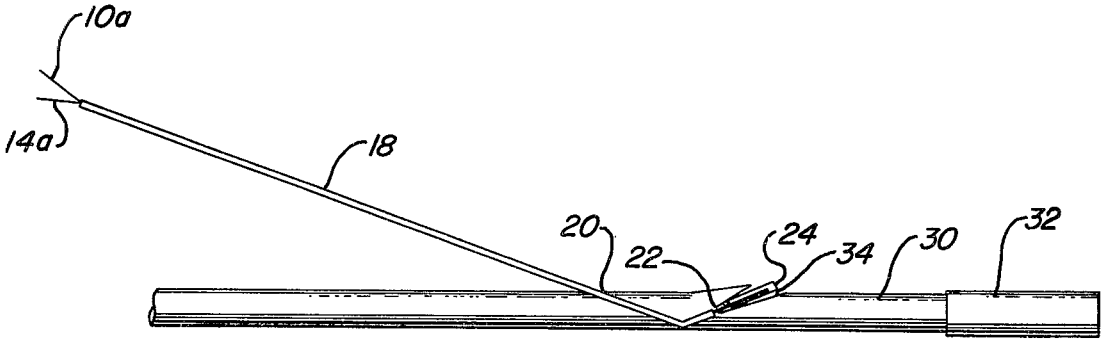
FIG. 5 is a side elevational view of the electrically actuated fuse ignitor in place ready for the detonation of a cap.

As shown in FIG. 2, the fuse ignitor is essentially planar except for the ends **10*b* and 14*b* of the electrical conductors which are bent at a slight angle to the plane of the lead wires. The angle is arranged to provide a secure fit of the fuse ignitor in a fuse. As shown in FIG. 3, a length of safety fuse 30, or the like, is secured by conventional means into a cap 32. The cap is a fuse ignited detonating cap commonly used commercially for a fuse having an ignition train. The length of the fuse 30 is not critical, but should be sufficiently long for the placement of the fuse ignitor therein, and to provide a structure for supporting the same. A slit 34 is cut into the fuse 30 sufficiently deep to expose the ignition train in the fuse. Preferably, the cut 34** is made at an angle of about 20° to 45° to the longitudinal axis through the fuse. The distance of the fuse from the cut to about the center of the detonating cap is predetermined to give a time delay from the actual firing of the ignition train of the fuse to the detonation of the cap. This distance may obviously extend adjacent the cap edge to a substantial distance from the cap to provide a long term delay, as determined by the rate of travel of the fire front in the ignition train in the fuse.

In using the ignitor of the invention, the unit is placed in a fuse, with the legs, adjacent the bridgewire, straddling the fuse, which is normally about a ¼ of an inch in diameter. The bridgewire and its supporting strengthening member 24 is forced into the cut 34 so that the bridgewire 22 is in close contact with the ignition train in the fuse. With the bridgewire in place, it may be secured therein by means of tape wrapped around the unit to hold the ignitor in the fuse. The bare ends 10*a* and 14*a* are attached to the two lead wires from an electric current source to provide current for the bridgewire. When the electrical system is initiated with sufficient current, the pyro-alloying reaction is initiated giving off a great deal of heat and many sparks are thrown, to ignite the core of the fuse. Once the ignition train is lit, it sets off the cap in the predetermined time interval.

The "Pyrofuse", mentioned above, may be obtained in different diameters, resistance and other physical and electrical characteristics. It is, however, of high tensile strength and it is easy to solder, so that making the assemblies of the ignitor is easy and inexpensive. Since the bridgewire does not exceed much over ¼ of an inch, the cost of the bridgewire is low making an inexpensive assembly. In one tested assembly, a strand of Pyrofuse of 0.002 inches diameter was initiated by the generator of a blasting machine. The pyro-alloying wire used in the present invention is not a resistance wire of the type used in detonator cap bridgewire circuits, and it has good conductivity. The assembly may be made for quite innocuous circuits, yet be initiated with relatively low voltage. High voltage does not create a problem, as an electrical source, and it may, also, be readily used. The 0.002 inch Pyrofuse requires about 0.6 amperes to initiate the alloying reaction. With the relatively high current necessary for initiating the reaction, stray currents are not normally sufficient to ignite the bridgewire and it, therefore, is very safe unit for detonating explosive charges.

The plastic support across the electrical leads adjacent the bridgewire may be a high dielectric, low conductance and high resistance material. This provides support for and protection for the bridgewire prior to insertion into the cut in the fuse, and, also, after insertion in the cut. It must be of a material that is essentially non-conducting with sufficient strength to support the assembly. The polyethylene, etc. plastic is satisfactory, as are many other type of plastic, wood, glass, etc. The non-thermal plastic materials may be cemented or otherwise secured in the proper position across the leads.

What is claimed is:

1. An electrically initiated pyro-detonation cap assembly resistant to static electricity comprising:

a. a length of fuse means of the ignition type having an ignition train;

b. a pyro-detonation cap secured to an end of said fuse means;

c. a cut in said of fuse means exposing the ignition train therein;

d. a pyro-alloying, conducting bridgewire mounted in said cut essentially in contact with said ignition train, said bridgewire comprising a pyro-alloying composition which is not a resistance wire, and e. an electrical lead secured to and extending from each end of said bridgewire to an electric current source, arranged to activate the alloying reaction of said bridgewire and ignite said fuse ignition train.

2. An electrically initiated pyro-detonation cap assembly according to claim 1, wherein said pyro-alloying composition includes a platinum group metal and aluminum.

3. An electrically initiated pyro-detonation cap assembly according to claim 1, wherein said cut is spaced from said cap at a predetermined distance, providing a predetermined time for ignition of the igniton train and a delay for detonation of said cap.

4. An electrically initiated pyro-detonaton cap assembly according to claim 1 wherein said fuse means is a safety fuse.

5. An electrically initiated pyro-detonation cap assembly according to claim 1, wherein said cut in said fuse means is at an angle to the longitudinal axis of said fuse means directed away from said cap.

6. An electrically initiated pyro-detonaton cap assembly according to claim 5, wherein said angle is from 20° to 45°.

7. An electrically initiated pyro-detonation cap assembly according to claim 1, wherein a non-conducting support member secured to the electrical leads adjacent said bridgewire reinforces the same.

8. An electrically initiated pyro-detonation cap assembly according to claim 7, wherein said electrical leads extend beyond said bridgewire and said non-conducting support member is secured to the extending ends.

9. An electrically initiated pyro-detonation cap assembly according to claim 8, wherein said non-conducting support member is a thermal plastic sheet.

10. An electrically initiated pyro-detonaton cap assembly according to claim 9, wherein said thermal plastic sheet is polyethylene.

* * * * *